United States Patent [19]

Colle

[11] 4,184,788

[45] Jan. 22, 1980

[54] FORM FOR EROSION CONTROL STRUCTURES

[75] Inventor: Ervin R. Colle, Haddonfield, N.J.

[73] Assignee: Raymond International, Inc., Houston, Tex.

[21] Appl. No.: 733,099

[22] Filed: Oct. 18, 1976

[51] Int. Cl.[2] ..... E02B 3/12

[52] U.S. Cl. ..... 405/19; 405/18

[58] Field of Search ..... 61/37, 38, 3–5, 61/86, 14 104

[56] References Cited

U.S. PATENT DOCUMENTS

| | | | |
|---|---|---|---|
| 483,697 | 10/1892 | Rich | 61/64 |
| 3,425,227 | 2/1969 | Hillen | 61/38 |
| 3,425,228 | 2/1969 | Lamberton | 61/38 |
| 3,474,626 | 10/1969 | Colle | 61/38 |
| 3,859,803 | 1/1975 | Pedersen et al. | 61/1 R X |
| 3,983,705 | 10/1976 | de Boer | 61/38 X |

*Primary Examiner*—Dennis L. Taylor

*Attorney, Agent, or Firm*—Arnold, White & Durkee

[57] ABSTRACT

A form for erosion control structures, which is made of at least two sheets of flexible material joined about their entire periphery forming a space adapted to receive a flowable material therein, is provided with a fluid transmitting material attached to one of the sheets about its periphery for equalizing hydrostatic pressure developing between the form and the surface upon which the form rests.

28 Claims, 8 Drawing Figures

FORM FOR EROSION CONTROL STRUCTURES

BACKGROUND OF THE INVENTION

1. Field of the Invention

The invention relates to a form for erosion control structures suitable for use along a shoreline, wherein fluid transmitting material is attached to the form for equalizing hydrostatic pressure developing between the form and the surface upon which the form rests.

2. Description of the Prior Art

In many instances, it is highly desirable to provide a shoreline with some type of structure for preventing the erosion of the shoreline by the action of waves and underwater currents. In the past, such structures have included concrete walls, beds of large boulders placed along the shoreline, or large concrete slabs lowered into the water upon the shoreline. In order to eliminate the many well-known problems attendant with the foregoing structures, it has been proposed to form a structure in situ along the shoreline in order to provide an erosion control structure.

Examples of this proposal are to be found in: U.S. Pat. No. 3,396,542, issued Aug. 13, 1968, to B. A. Lamberton; U.S. Pat. No. 3,425,228, issued Feb. 4, 1969, to B. A. Lamberton; U.S. Pat. No. 3,474,626, issued Oct. 28, 1969, to the present inventor; U.S. Pat. No. 3,520,142, issued July 14, 1970, to L. A. Turzillo; U.S. Pat. No. 3,524,320, issued Aug. 18, 1970, to L. A. Turzillo; U.S. Pat. No. 3,565,125, issued Feb. 23, 1971, to John T. Hayes; U.S. Pat. No. 3,570,254, issued Mar. 16, 1971, to L. A. Turzillo; and U.S. Pat. No. 3,837,169, issued Sept. 24, 1974 to B. A. Lamberton. In the foregoing patents, it has been proposed to use a fabric form comprised of two or more flexible sheets of material which are joined to form a space adapted to have a cementitious slurry injected therein. Those disclosed forms are placed upon the shoreline, or surface to be protected, and are then filled with the cementitious slurry, whereby a concrete revetment mat, or slab, is formed upon the surface to be protected from wave action.

A major problem encountered in using the foregoing forms of Lamberton is in providing some means for the relief of hydrostatic pressure which develops between the concrete mat and the surface upon which the mat rests. If the forms are not provided with means for relieving such hydrostatic pressure, the slabs produced by the foregoing patents can be moved by such hydrostatic pressure or washed away by the currents or wave action.

Turzillo utilizes a plurality of stakes to anchor his forms to the shoreline, a costly and time consuming operation. Alternatively, in U.S. Pat. No. 3,524,320, Turzillo relies upon excess cement grout oozing through his form into the surface upon which the form rests, whereby the form is bonded to the surface below the form. It is believed that this approach does not sufficiently provide an adequate anchoring means for the form, nor is there any provision disclosed for the relief of hydrostatic pressure developing beneath the form.

In the other forms disclosed in the foregoing patents, with the exception of U.S. Pat. No. 3,837,169, the forms are provided with a plurality of openings throughout the forms to provide for relief of hydrostatic pressure. A major problem associated with those openings is that they can become clogged with the growth of underwater plant life, whereby they become ineffective to relieve hydrostatic pressure developing beneath the form. Additionally, the soil and rocks beneath the form may tend to clog those openings. Accordingly, in my prior patent, I proposed the use of a filter cloth beneath the openings to prevent soil and rocks from clogging those openings. However, such openings could still become clogged from the growth of underwater plant life.

Furthermore, another major problem with forms having openings formed therein is that the areas surrounding those openings are areas of structural weakness in the form. These areas of structural weakness, or stress points, are subject to ripping open due to the exertion of pumping pressure forces during the filling operation of these forms. If such damage occurs to the form, it cannot be properly filled, nor will an effective erosion control structure be formed upon the underwater surface.

Accordingly, prior to the development of the present invention, there has been no form available for erosion control structures which adequately provides for equalizing hydrostatic pressure developing between the form and the surface upon which the form rests. Therefore, the art has sought a form for erosion control structures which adequately provides for equalization of such hydrostatic pressure, absent the problems of previously proposed forms.

SUMMARY OF THE INVENTION

In accordance with the invention, the foregoing has been achieved through the present form for erosion control structures.

The present invention includes a form for erosion control structures, suitable for use along a shoreline, which comprises at least two sheets of flexible material, joined about their entire periphery, whereby a space is formed which is adapted to receive a flowable material therein. One of the sheets is at least in part porous and a first fluid transmitting material is attached to one of the sheets about its periphery for equalizing hydrostatic pressure developing between the form and the surface upon which the form rests.

In one embodiment of the present invention the fluid transmitting material is a woven screen material. The sheet of flexible material in contact with the surface upon which the form rests may be impervious to water.

As indicated above, in more specific terms, the forms of the present invention may include a sheet or strip of porous reinforcing material disposed between the two sheets of flexible material within the space adapted to receive the flowable material. The outer edges of this sheet or strip of porous reinforcing material are attached to the periphery of the two sheets of flexible material. The outer edges of the sheet or strip of porous reinforcing material may extend beyond the periphery of the two sheets of flexible material and the porous reinforcing material is disposed in a fluid transmitting relationship with the first fluid transmitting material.

In another aspect of the present invention, a second fluid transmitting material may be attached to the flexible sheet of material in contact with the surface upon which the form rests, and this second fluid transmitting material is disposed in a fluid transmitting relationship with the first fluid transmitting material. The second fluid transmitting material may be attached to the flexible sheet of material in contact the surface upon which the form rests and in a fluid transmitting relationship to the first fluid transmitting material and the porous reinforcing material.

In another aspect of the present invention, a plurality of these forms may be disposed in an abutting relationship with respect to adjacent forms. The extended outer edges of each sheet of porous reinforcing materials of adjacent forms may be connected to one another, with the first and second fluid transmitting materials disposed in a fluid transmitting relationship with the porous reinforcing material.

The form of the present invention, when compared with previously proposed prior art forms, has the advantages of efficiency in equalizing hydrostatic pressure and elimination and unnecessary areas of structural weakness in the forms, along with the attendant cost savings in not having to provide the openings of the prior art forms.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
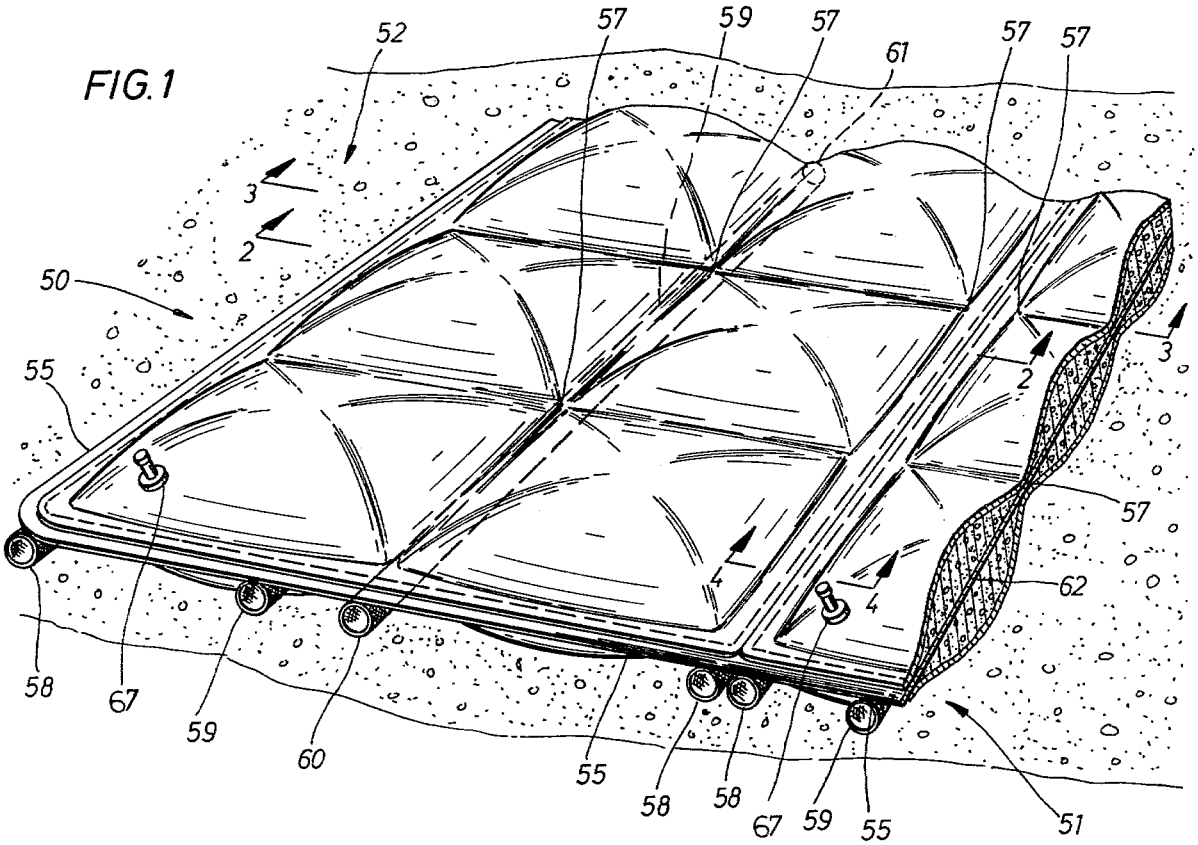
FIG. 1 is a perspective view of a form for erosion control structures in accordance with the present invention.

Referring now to FIG. 1, two forms, 50 and 51, in accordance with the present invention are shown. Form 51 is identical in construction to form 50 and for ease of description only the construction of form 50 will be set forth in detail.

Forms 50 and 51 are disposed in an abutting relationship along the surface 52 of a shoreline for which an erosion control structure is desired to prevent the erosion of surface 52 from water currents and wave action. Form 50 is comprised of at least two continuous sheets of flexible material 53 and 54 which are joined about their entire periphery 55. The term "continuous sheets" does not include sheets of material having a plurality of openings therein for the relief of hydrostatic pressure as is shown in the prior art previously referred to in this specification. Sheets 53 and 54 may be made from any suitable flexible material which has the requisite flexibility and abrasion resistance necessary for a form which will be easily handled in use and capable of being in contact with a suitable flowable material. Preferably, at least one of the sheets 53 or 54 must be at least in part porous, so as to allow the passage of air through its surface as the form is filled. Suitable materials for sheets 53 and 54 may be various types of nylon fabric, rubberized fabric material, flexible polyvinylchloride, flexible sheets of fiberglass material, or any other material having the requisite flexibility, porosity, and abrasion-resistant characteristics. One material in particular which has been found to be suitable for use as a sheet which is at least in part porous is Mirafi ®, manufactured by Celanese, Inc.

In one of the embodiments of the present invention, to be hereinafter described, the flexible sheet of material in contact with surface 52 upon which form 50 rests upon, may be made of a material impervious to water, such as a rubberized sheet of nylon or other plastic material.

Sheets 53 and 54 are joined about their periphery by any conventional means, whereby periphery 55 will be impervious to water. As a preferred method, sheets 53 and 54 are joined at their periphery 55 by the means of any suitable epoxy resin or glue, sewing, heat or ultrasonic bonding.

Figure 2:
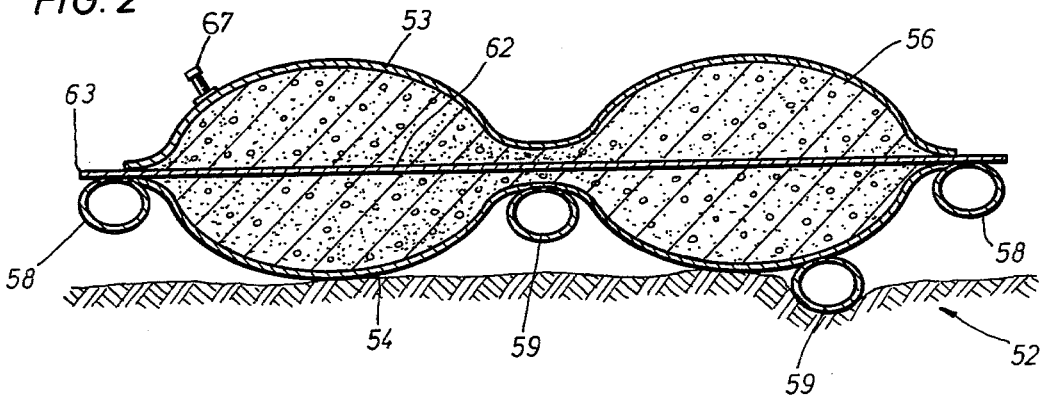
FIG. 2 is a cross-sectional view taken along line 2—2 of FIG. 1.

Referring now to FIG. 2, it is seen that sheets 53 and 54 are joined about their entire periphery 55 to thus form a space 56 adapted to receive a flowable material therein. A conventional nozzle 67 is provided on sheet 53 to enable space 56 to be filled with a flowable material. Alternatively, an opening may be provided in the sheet 53 to accept a filling hose unit (not shown). Nozzle 67 may be located anywhere along the outer surface of upper sheet 53, such that it is accessible to be engaged by a conventional filling hose (not shown) leading from a conventional reservoir of flowable material (not shown). Form 50 is adapted to be filled with any suitable material which can flow into form 50 and fill the entire space 56. Such materials include any of the various conventionally known cementitious slurries, which can harden when disposed under a body of water; or various forms of commercially available flowable asphalts.

Figure 3:
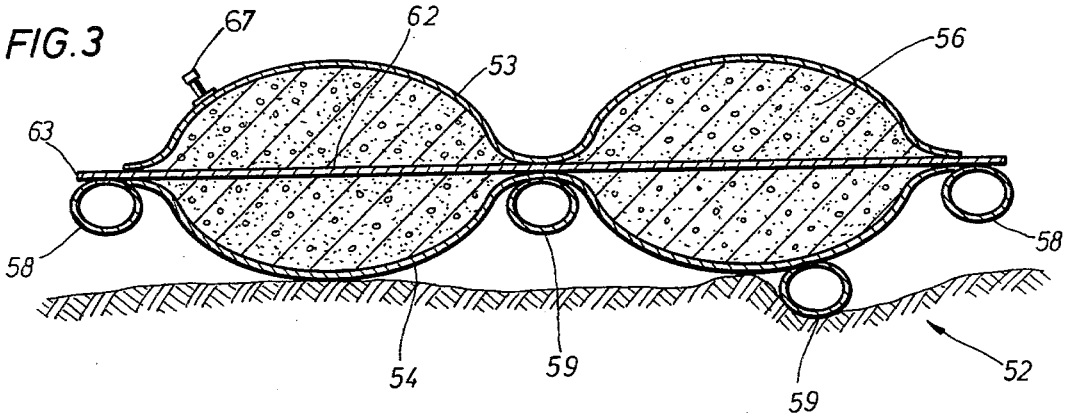
FIG. 3 is a cross-sectional view taken along line 3—3 of FIG. 1.

As shown in FIGS. 1 and 3, upper sheet 53 and lower sheet 54 may be additionally joined at a plurality of locations 57 disposed within the periphery 55 of sheets 53 and 54. Sheets 53 and 54 may likewise be joined at locations 57 by means of a suitable epoxy resin or glue, sewing, heat, or ultrasonic bonding. On course, it should be readily apparent to one of ordinary skill in the art that sheets 53 and 54 could likewise be joined at locations 57 by means of various types of strings or wires (not shown).

As shown in FIGS. 1–3, a first fluid transmitting material 58 is attached to the underside of form 50 about its entire periphery 55. Fluid transmitting material 58 is shown to be attached to the entire periphery of sheet 54. Alternatively, fluid transmitting material 58 can be attached to one or more of the outer edges of sheet 54 which constitute periphery 55 and material 58 may be continuous or in short lengths. Fluid transmitting material 58 may be comprised of strips, rolls, or wicks of any suitable porous, fluid transmitting material. A woven screen material has been found to be particularly suitable for use as fluid transmitting material 58. Fluid transmitting material 58 may be attached to sheet 54 in any conventional manner, including gluing it with an epoxy resin or glue, or by sewing it to the periphery of sheet 54.

The first fluid transmitting material 58 functions to equalize hydrostatic pressure developing between form 50 and surface 52 upon which form 50 rests by transmitting the hydrostatic pressure and water to and/or through the periphery 55 of form 50 whereby it is released into the water overlying or below form 50.

Additionally a second fluid transmitted material 59, of the same construction as the first fluid transmitting material 58, may be attached to lower sheet 54. This second fluid transmitting material may be likewise attached to sheet 54 by means of an epoxy glue or resin or by sewing. The second fluid transmitting material 59 may be disposed anywhere along the outer surface of sheet 54; e.g., fluid transmitting material 59 may be disposed diagonally across form 50 or parallel to perpendicular to the longitudinal axis of form 50. However, the second fluid transmitting material 59 is disposed in a fluid transmitting relationship to the first fluid transmitting material 58. This fluid transmitting relationship may be achieved by having both ends 60 and 61 of fluid transmitting material 59 connected to the first fluid transmitting material 58, as shown in FIG. 1. The first and second fluid transmitting materials may be connected by either sewing first and second fluid transmitting materials 58 and 59 together, or by merely abutting them, one against the other. Alternatively, ends 60 and 61 may extend toward periphery 55 and upwardly pass through periphery 55 to transmit fluid to the water overlying form 50.

The second fluid transmitting material 59 serves to provide an additional equalization of hydrostatic pressure by channeling that pressure and any water from beneath form 50 to the periphery 55 of form 50, whereby the first fluid transmitting material 58 releases that water and pressure to the water above form 50.

When lower sheet 54 is made of a material impervious to water, the passage of water through form 50 is eliminated, whereby impervious sheet 54 forces any water or hydrostatic pressure to be channeled to fluid transmitting materials 58 and 59. Accordingly, an efficient and inexpensive means is provided for equalizing hydrostatic pressure developing between form 50 and surface 52.

Referring now to FIGS. 2 and 3, form 50 may be provided with a sheet 62 of porous reinforcing material disposed between sheets 53 and 54 within space 56. The outer edges 63 of sheet 62 are attached to the periphery 55 of sheets 53 and 54. If sheet 62 is utilized, sheet 62 is sandwiched between sheets 53 and 54 and sheets 53 and 54 are suitably joined to the outer edge 63 of sheet 62 in the manner hereinbefore described. Sheet 62 would likewise be joined to sheets 53 and 54 at locations 57 as shown in FIG. 3.

Sheet 62 of porous reinforcing material may be made of any suitable material which is sufficiently open in construction so as to allow for the free and unobstructed passage of the flowable material which fills space 56. Sheet 62 may be made of a suitable woven screen material or mesh. Sheet 62 serves to provide a reinforcement for the revetment mat formed by form 50, whereby cracking or disintegration of the formed mat will be restricted.

As shown in FIGS. 2 and 3, the outer edges 63 of sheet 62 of porous reinforcing material may extend beyond the periphery 55 of sheets 53 and 54 in a fluid transmitting relationship with the first fluid transmitting material 58. The outer edges 63 of the sheet 62 of porous reinforcing material may be suitably joined to the first fluid transmitting material 58 by sewing or by merely having outer edge 63 abut material 58. Accordingly, the outer edges 63 also serve to assist the fluid transmitting material 58 in equalizing hydrostatic pressure and allowing the passage of water to the body of water overlying form 50. The second fluid transmitting material 59 may be likewise disposed in a fluid transmitting relationship with the outer edges 63 of sheet 62.

Figure 7:
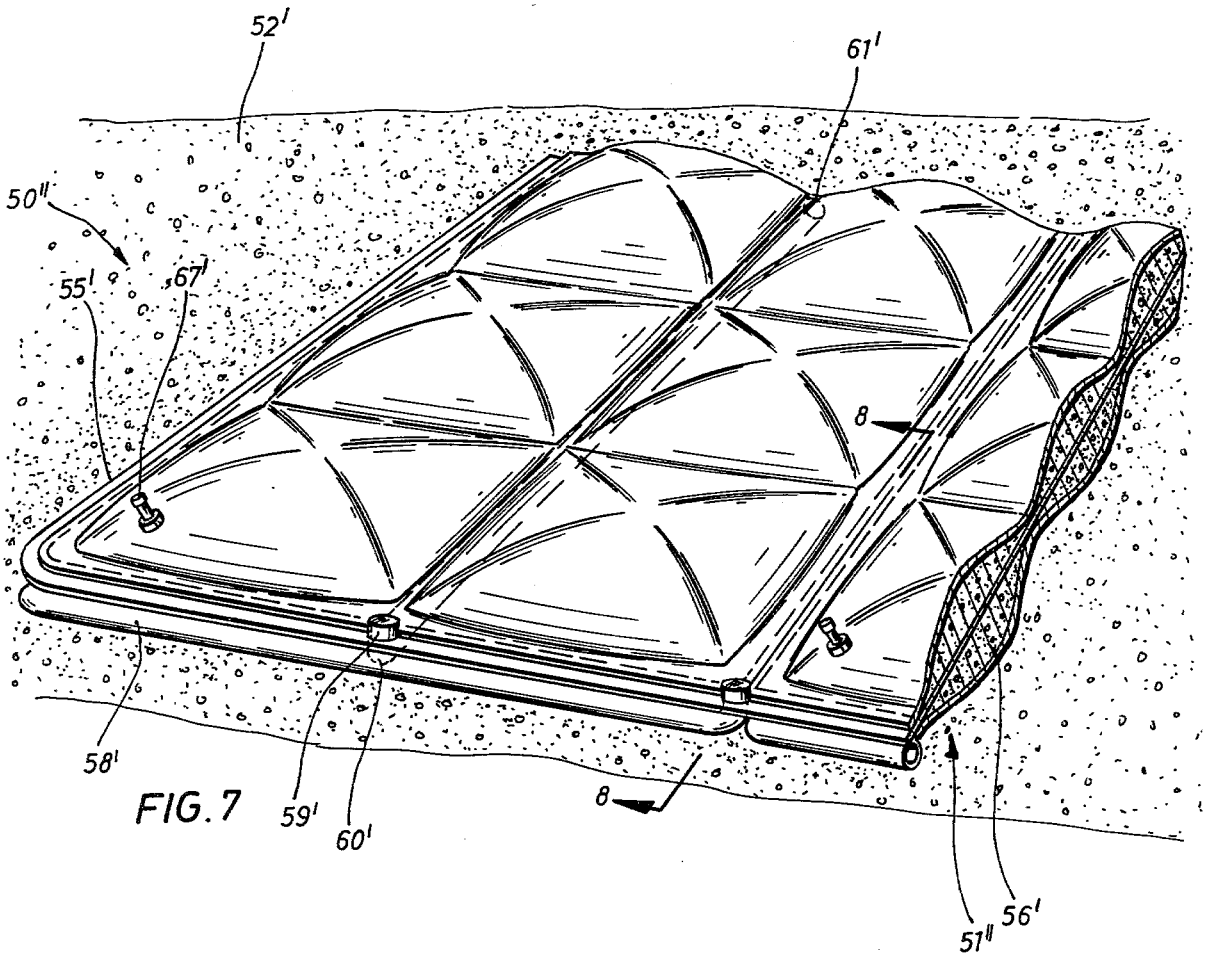
FIG. 7 is another perspective view of a form for erosion control structures in accordance with the present invention.
Figure 8:
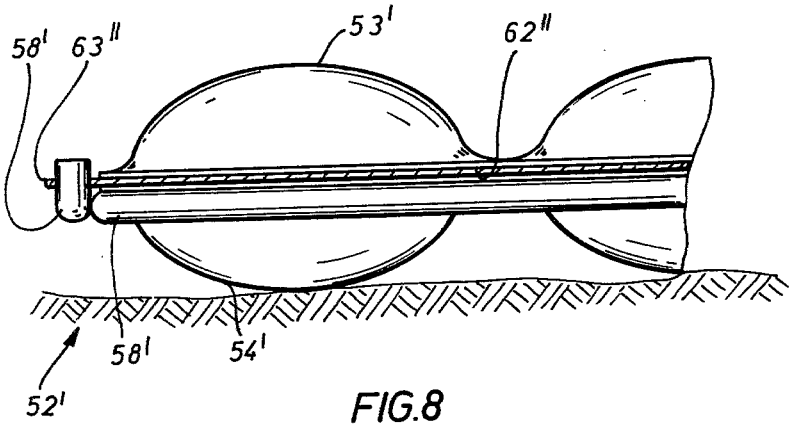
FIG. 8 is a cross-sectional view taken along line 8—8 of FIG. 7.

As shown in FIGS. 7 and 8, another form 50'' is shown, wherein the primed and double primed reference numerals correspond to those components having corresponding umprimed numbers as previously described. It is seen that the second fluid transmitting material 59' is disposed in a fluid transmitting relationship to the first fluid transmitting material 58', by having end 60' abutting against first fluid transmitting material 58'. As shown in FIGS. 7 and 8, end 60' of the second fluid transmitting material 59', or the end of first fluid transmitting material 58', may upwardly pass through periphery 55' to transmit fluid to the water overlying form 50''.

Figure 6:
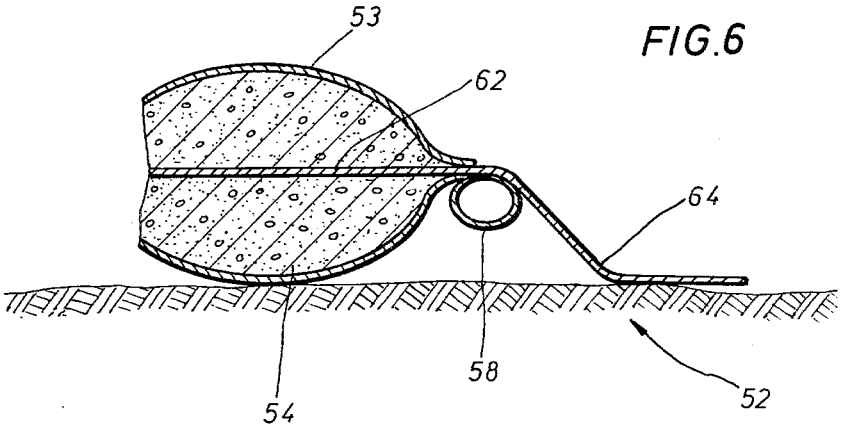
FIG. 6 is a modified partial cross-section view taken along line 2—2 of FIG. 1.

As shown in FIG. 6, the outer edges 63 of sheet 62 can be extended beyond lower edge of form 50 and contact surface 52 to form an apron 64 to prevent undercutting or scour of form 50.

In utilizing the form 50 of the present invention, a form structure is prepared by utilizing a plurality of forms 50. For purposes of illustration, FIG. 1 shows a form structure comprised of forms 50 and 51. It should be noted that forms 50 and 51 may be manufactured in any convenient size or shape, as should be readily apparent to one of ordinary skill in the art. Accordingly, as many forms 50 are utilized to create a form structure, dependent upon the size of form 50 and the size of the area for which an erosion control structure, or revetment mat is desired. The plurality of forms 50 and 51 are disposed in an abutting relationship with respect to adjacent forms as shown in FIG. 1. A hose (not shown) is then attached to the nozzle 67 on each forms 50 and 51 and the forms 50 and 51 are then filled with a flowable material, whereby upon hardening of the flowable material an erosion control structure, or revetment mat, is formed upon surface 52. Fluid transmitting material 58 and/or 59 provide an efficient means for equalizing hydrostatic pressure developing between forms 50 and 51 and suface 52 upon which forms 50 and 51 rest.

Figure 4:
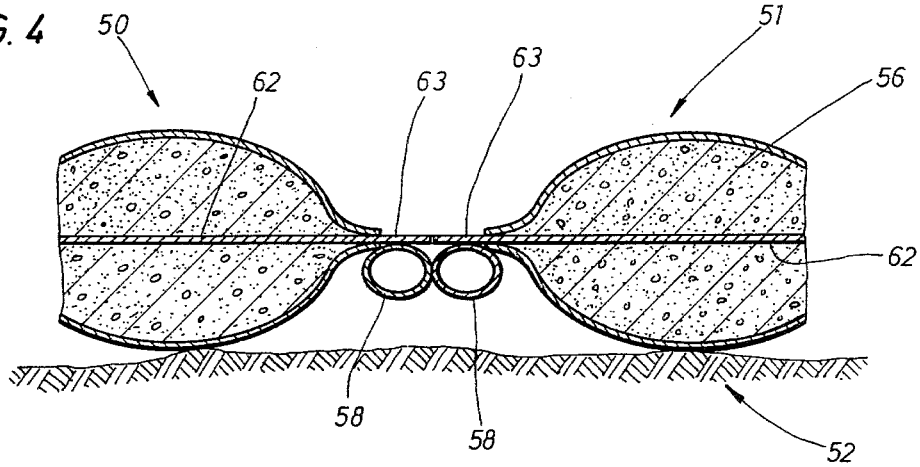
FIG. 4 is a partial cross-sectional view taken along line 4—4 of FIG. 1.

Alternatively, as shown in FIG. 4, mats 50 and 51 may be physically connected to one another via the extended outer edges 63 of sheet 62. By having edges 63 of sheet 62 extend beyond peripheries 55 of forms 50 and 51, the edges 63 may be connected by any suitable means, such as sewing them together, or by means of an epoxy glue or resin. Accordingly, forms 50 and 51 are mechanically connected, whereby the connected edges 63 of forms 50 and 51 serve as a flexible hinge connection between adjacent mats. Additionally, since sheet 62 is made of a porous reinforcing material, the extended outer edges 63 serve as an additional fluid transmitting material for relieving and equalizing hydrostatic pressure developing beneath forms 50 and 51.

Figure 5:
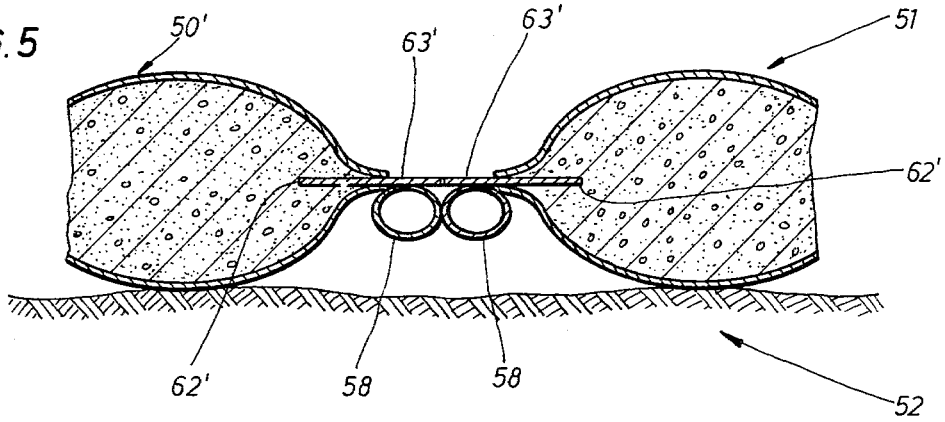
FIG. 5 is a modified partial cross-section view taken along line 4—4 of FIG. 1.

Turning now to FIG. 5 another embodiment of the present invention is shown wherein forms 50' and 51' are shown wherein the construction of forms 50' and 51 is the same as that described previously with the exception that a strip 62' of a porous reinforcing material is utilized rather than a sheet 62. Strips 62' are attached to sheets 53 and 54 in the same manner previously described, with their outer edges 63' extending beyond the periphery 55 of forms 50′ and 51′. As previously described, strips 62′ are joined together, thus forming a flexible mechanical hinge between adjacent forms 50′ and 51′. Connected strips 62′ are likewise disposed in a fluid transmitting relationship with fuid transmitting material 58 and/or 59, whereby strip 62 provides an additional means for relieving hydrostatic pressure developing between forms 50′ and 51′ and surface 52.

The foregoing description of the invention has been directed in primary part to a particular preferred embodiment in accordance with the requirements of the Patent Statutes and for purposes of explanation and illustration. It will be apparent, however, to those skilled in this art that many modifications and changes in the specific apparatus utilized may be made without departing from the scope and spirit of the invention. For example, the form of the present invention could be made entirely of a material impervious to water and air with a suitable check valve for allowing any entrapped air within the form to be released upon filling of the form with a flowable material.

It is applicant's intention in the following claims to cover such modifications and variations as fall within the true spirit and scope of the invention.

What is claimed is:

1. A form for erosion control structures suitable for use along a shoreline comprising;

at least two continuous sheets of flexible material joined about their entire periphery forming a space adapted to receive a flowable material therein;

first fluid transmitting means attached to one of said sheets about its periphery for equalizing hydrostatic pressure developing between the form and the surface upon which the form rests; and second fluid transmitting means attached to the flexible sheet of material in contact with the surface upon which the form rests, said second fluid transmitting means being disposed in a fluid transmitting relationship to said first fluid transmitting means.

2. The form of claim 1 wherein said fluid transmitting means is a woven screen material.

3. The form of claim 1 wherein the sheet of material in contact with the surface upon which the form rests is impervious to water.

4. The form of claim 1 wherein a sheet of porous reinforcing material is disposed between said two sheets of flexible material within the space to receive said flowable material, the outer edges of said sheet of porous reinforcing material being attached to the periphery of said two sheets.

5. The form of claim 4 wherein the outer edges of said sheet of porous reinforcing means extend beyond the periphery of said two sheets of flexible material, and said porous reinforcing material is disposed in fluid transmitting relationship with said first fluid transmitting material.

6. The form of claim 3 wherein a second fluid transmitting means is attached to said sheet of material which is impervious to water, said second fluid transmitting means being disposed in fluid transmitting relationship to said first fluid transmitting means.

7. The form of claim 5 wherein a second fluid transmitting means is attached to the flexible sheet of material in contact with the surface upon which the form rests, said second fluid transmitting means being disposed in fluid transmitting relationship to said first fluid transmitting means and said porous reinforcing material.

8. The form of claim 1 wherein a strip of porous reinforcing material is disposed between said two sheets of flexible material within the space adapted to receive said flowable material, the outer edges of said strip of porous reinforcing material being attached to the periphery of said two sheets.

9. The form of claim 8 wherein the outer edges of said strip of porous reinforcing material extend beyond the periphery of said two sheets of flexible material, and said strip of porous reinforcing material is disposed in fluid transmitting relationship with said first fluid transmitting means.

10. The form of claim 9 wherein a second fluid transmitting means is attached to the flexible sheet of material in contact with the surface upon which the form rests, said second fluid transmitting means being disposed in fluid transmitting relationship to said first fluid transmitting means and said strip of porous reinforcing material.

11. A form structure for erosion control structures suitable for use along a shoreline comprising in combination:

a plurality of forms each form including at least two sheets of flexible means joined about their entire periphery forming a space adapted to receive a flowable material therein, and first fluid transmitting means attached to one of said sheets about its periphery for equalizing hydrostatic pressure developing between the form and the surface upon which the form rests; and each form being disposed in an abutting relationship with respect to adjacent forms.

12. The form structure of claim 11 wherein said fluid transmitting material is a woven screen means.

13. The form structure of claim 11 wherein the sheets of material in contact with the surface upon which the forms rest are impervious to water.

14. The form structure of claim 11 wherein a sheet of porous reinforcing material is disposed between said two sheets of flexible material within the space adapted to receive said flowable material, the outer edges of said sheet of porous reinforcing material being attached to the periphery of said two sheets.

15. The form structure of claim 14 wherein the outer edges of said sheet of porous reinforcing material extend beyond the periphery of said two sheets of flexible material, and said porous reinforcing material is disposed in fluid transmitting relationship with said first fluid transmitting material.

16. The form structure of claim 14 wherein the outer edges of said sheet of porous reinforcing material extend beyond the periphery of said two sheets of flexible material and contact the surface upon which the forms rest, whereby undercutting and scour of the form structure is prevented.

17. The form structure of claim 12 wherein a second fluid transmitting means is attached to the flexible sheet of material in contact with the surface upon which the forms rest, said second fluid transmitting means being disposed in fluid transmitting relationship to said first fluid transmitting means.

18. The form structure of claim 13 wherein a second fluid transmitting means is attached to said sheet of material which is impervious to water, said second fluid transmitting means being disposed in fluid transmitting relationship to said first fluid transmitting means.

19. The form structure of claim 12 wherein a second fluid transmitting means is attached to the flexible sheet of material in contact with the surface upon which the forms rest, said second fluid transmitting means passing upwardly through the periphery of each form.

20. The form structure of claim 12 wherein a second fluid transmitting means is attached to said sheet of material which is impervious to water, said second fluid transmitting means passing upwardly through the periphery of each form.

21. The form structure of claim 15 wherein a second fluid transmitting means is attached to the flexible sheet of material in contact with the surface upon which the forms rest, said second fluid transmitting means being disposed in fluid transmitting relationship to said first fluid transmitting means and said porous reinforcing material.

22. The form structure of claim 15 wherein the extended outer edges of each sheet of porous reinforcing material of adjacent forms are connected to one another.

23. The form structure of claim 22 wherein a second fluid transmitting material is attached to the flexible sheet of material in contact with the surface upon which the forms rest, said second fluid transmitting material being disposed in fluid transmitting relationship to said first fluid transmitting material and said porous reinforcing material.

24. The form structure of claim 11 wherein a strip of porous reinforcing material is disposed between said two sheets of flexible material within the space adapted to receive said flowable material, the outer edges of said strip of porous reinforcing material being attached to the periphery of said two sheets.

25. The form structure of claim 24 wherein the outer edges of said strip of porous reinforcing material extend beyond the periphery of said two sheets of flexible material, and said porous reinforcing material is disposed in fluid transmitting relationship with said first fluid transmitting means.

26. The form structure of claim 25 wherein a second fluid transmitting means is attached to the flexible strip of material in contact with the surface upon which the forms rest, said second fluid transmitting means being disposed in fluid transmitting relationship to said first fluid transmitting means and said porous reinforcing material.

27. The form structure of claim 25 wherein the extended outer edges of each strip of porous reinforcing material of adjacent forms are connected to one another.

28. The form structure of claim 27 wherein a second fluid transmitting means is attached to the flexible sheet of material in contact with the surface upon which the form rests, said second fluid transmitting means being disposed in fluid transmitting relationship to said first fluid transmitting means and said porous reinforcing material.

* * * * *

UNITED STATES PATENT AND TRADEMARK OFFICE

CERTIFICATE OF CORRECTION

PATENT NO. : 4,184,788
DATED : January 22, 1980
INVENTOR(S) : Ervin R. Colle

It is certified that error appears in the above-identified patent and that said Letters Patent are hereby corrected as shown below:

Column 2, line 67, after "contact" insert --with--.

Column 3, line 14, delete "and" (second occurrence) and insert --of--.

Column 3, line 30, delete "cross-section" and insert --cross-sectional--.

Column 3, line 32, delete "cross-section" and insert --cross-sectional--.

Column 5, line 7, delete "transmitted" and insert --transmitting--.

Column 6, line 46, delete "suface" and insert --surface--.

Column 6, line 63, delete "51" and insert --51'--.

Column 7, line 5, delete "fuid" and insert --fluid--.

UNITED STATES PATENT AND TRADEMARK OFFICE

CERTIFICATE OF CORRECTION

PATENT NO. : 4,184,788

DATED : January 22, 1980

INVENTOR(S) : Ervin R. Colle

It is certified that error appears in the above-identified patent and that said Letters Patent are hereby corrected as shown below:

IN THE CLAIMS:

Claim 5, line 2, delete "means" and insert --material--.

Claim 5, line 6, delete "material" and insert --means--.

Claim 11, line 5, before "sheets" insert --continuous--.

Claim 11, line 5, delete "means" and insert --material--.

Claim 12, line 2, delete "material" and insert --means--.

Claim 12, line 2, delete "means" and insert --material--.

Claim 15, line 6, delete "material" and insert --means--.

UNITED STATES PATENT AND TRADEMARK OFFICE

CERTIFICATE OF CORRECTION

PATENT NO. : 4,184,788
DATED : January 22, 1980
INVENTOR(S) : Ervin R. Colle

It is certified that error appears in the above-identified patent and that said Letters Patent are hereby corrected as shown below:

IN THE CLAIMS:

Claim 23, line 2, delete "material" and insert --means--.

Claim 23, line 4, delete "material" and insert --means--.

Claim 23, line 6, delete "material" and insert --means--.

Claim 28, line 4, delete "form rests," and insert --forms rest,--.

Signed and Sealed this

*Fifteenth* Day of *July 1980*

[SEAL]

*Attest:*

SIDNEY A. DIAMOND

*Attesting Officer*

*Commissioner of Patents and Trademarks*